US005302055A

United States Patent [19]

Johnston

[11] Patent Number: 5,302,055

[45] Date of Patent: Apr. 12, 1994

[54] SIGNALLING DEVICE

[76] Inventor: David A. Johnston, 10 Jainba Street, Indooroopilly, Queensland, 4068, Australia

[21] Appl. No.: 910,145

[22] PCT Filed: Nov. 13, 1991

[86] PCT No.: PCT/AU91/00521

§ 371 Date: Jul. 15, 1992

§ 102(e) Date: Jul. 15, 1992

[87] PCT Pub. No.: WO92/10401

PCT Pub. Date: Jun. 25, 1992

[30] Foreign Application Priority Data

Dec. 11, 1990 [AU] Australia ..... PK3833

[51] Int. Cl.[5] ..... B63C 11/26

[52] U.S. Cl. ..... 405/186; 116/26; 116/112; 441/89

[58] Field of Search ..... 405/185, 186, 187; 116/26, 27, 112, 113; 441/80, 88, 89

[56] References Cited

U.S. PATENT DOCUMENTS 3,277,437 4/1965 Bouyoucos .
3,433,202 3/1969 Sharp et al. .
3,895,561 7/1975 Felderhof et al. .
4,095,667 6/1978 Mahig et al. .
4,852,510 8/1989 Joseph et al. ..... 405/186 X
4,950,107 8/1990 Hancock et al. ..... 405/186
5,022,790 6/1991 Stevenson .

FOREIGN PATENT DOCUMENTS

28351/67 4/1969 Australia .
34646/89 4/1990 Australia .
827206 1/1938 France .
898967 7/1944 France .
1330414 9/1973 United Kingdom .
1362213 7/1974 United Kingdom .
1389068 4/1975 United Kingdom .

*Primary Examiner*—David H. Corbin
*Attorney, Agent, or Firm*—Foley & Lardner

[57] ABSTRACT

A signalling device for scuba divers uses their compressed air supply to drive a piston (42, 51, 72) against a diaphragm (22, 48, 49, 57, 63, 90) to generate sound in water against the diaphragm. A bistable valve 34, 52) switches pressurised air alternately to opposite ends of the piston (42, 51, 72) to cause it to reciprocate and repeatedly impact against the diaphragm (22, 48, 49, 57, 63, 90). Air is exhausted from the cylinder (11, 54, 70) through ports (27, 28, 29, 30, 110, 111, 73, 74), the ports being valved by movement of the piston.

19 Claims, 6 Drawing Sheets

SIGNALLING DEVICE

FIELD OF THE INVENTION

THIS INVENTION relates to signalling devices and in particular to a signalling device which can be used underwater to signal to and between divers.

BACKGROUND TO INVENTION

Various means have been devised by which acoustic signals may be generated underwater. Generally these comprise pistons impacting against a diaphragm in contact with water. U.S. Pat. Specification No. 4,095,667 to Mahig and Allen describes a portable underwater signalling device. Other acoustic signal generators are described in U.S. specifications 3,433,202 to Sharp et al and 3,277,437 to Bouyoucos.

In Mahig and Allen, U.S. Pat. No. 4,095,667, the valving to drive the piston and the piston involve complex shapes and sealing arrangements.

In Sharp, U.S. Pat. No. 3,433,202, and Bouycousos, U.S. Pat. No. 3,277,437, valving is achieved externally of the device such that these devices are not useful to divers needing a small hand held acoustic generator.

OBJECT OF THE INVENTION

It is an object of the invention to provide a signalling device by which communication between divers is possible with an acoustic generator of simple construction which is able to be hand held or incorporated into other equipment such as buoyancy control devices and which is a unit requiring only a high pressure air line connected thereto.

The invention achieves its object in providing a signalling device for underwater use comprising:

a main body part having a bore therein to form a cylinder with at least one open end thereto;

a diaphragm fitted to the main body part over the at least one open end of the cylinder, the diaphragm being, in use, in contact with water;

a piston contained within the cylinder, for movement to and fro therein;

an inlet to the cylinder on the main body part whereat a pressurised gas may be supplied; and a valve means mounted in the main body part between the inlet and the cylinder; and the valve means, in use, switching pressurised gas to opposite ends of the piston to repetitively drive the piston against the diaphragm.

In a particular form of the invention there is provided a pneumatic signalling device for hand held use by divers when underwater, said signalling device comprising:

a main body part having a bore therein to form a cylinder with an open end thereto;

a diaphragm fitted to the main body part over the open end of the cylinder, the diaphragm being, in use, in contact with the water;

a piston with first and second pressure faces at opposite ends thereto contained within the cylinder for movement to and fro therein, to impact the end associated with the first pressure face against the diaphragm;

an inlet to the cylinder on the main body part whereat an air line may be attached to feed air under pressure to a flapper valve; and a flapper valve mounted in the main body part between the inlet and the cylinder;

action of the flapper valve under pressure of air serving to switch pressurised air repetitively to first the second pressure face and then the first pressure face to drive the piston to and from the diaphragm to repeatedly impact thereagainst and generate, in use, an acoustic signal in the water.

In this specification the terms bistable and flapper valve are to include any valve suitable to switching an inlet to either of two outlets, the state of the valve being switchable to either of the two outlets by any suitable means.

BRIEF DESCRIPTION OF DRAWINGS

The invention will now be described with reference to a preferred embodiment as shown in the accompanying drawings in which.

The drawings are meant to be schematic representations only. Relative proportions are varied to accord with a need to explain the invention and do not necessarily represent what would be used in practice.

DETAILED DESCRIPTION

Figure 4:
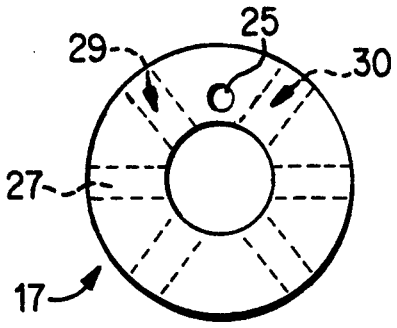
FIG. 4 is a view of the cylinder of FIG. 1 looking at the diaphragm end.
Figure 5:
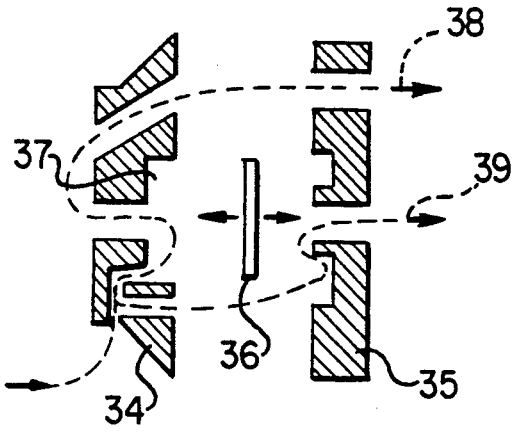
FIG. 5 is a sectional view through the parts of a valve which may be employed in the signalling device of FIGS. 1 to 4.
Figure 6:
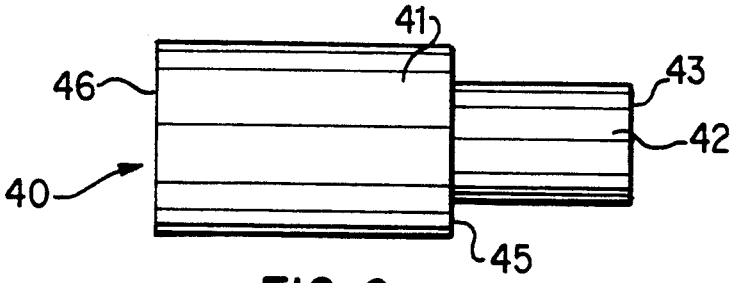
FIG. 6 is a view of a piston which may be employed in the signalling device of FIGS. 1 to 4.

In FIGS. 1 to 4, signalling device 10 comprises a main body part 11 which is bored therethrough to serve as a cylinder for a piston of the type shown in FIG. 6. The bore in the main body part is closed at an air inlet end by an end cap 12. A locking ring 13 holds a diaphragm 22 at the other open end of the bore against the end of the main body part. End cap 12 may be provided with an external thread 14 which when in place engages in internal thread 15 of the main body part 10. An internal thread 16 on locking ring 13 may be used to engage with an external thread 17 on the main body part. End cap 12 may be provided with two externally accessible, shallow, closed bores 18 and 19 at which a suitable tool may be fitted to enable end plug 12 to be screwed into place. End cap 12 may be provided with a threaded bore 20 at which a compressed air line might be removably coupled. Any other suitable means of coupling a compressed air line may be used such as the well-known clip-on disconnectable couplings. Compressed air inlet 20 communicates in this embodiment with a transverse bore 21 which serves to pass compressed air which is supplied at the inlet by the air line to the chamber 33. At the other end of the main body part 11, the diaphragm 22 is held by a shoulder 23 on the locking ring 16 onto the inner edge of the outermost shoulder of the recess 24 at the end of the main body part 11. The recess 24 is provided to allow the diaphragm freedom to "ring", or rebound, after the initial piston (see FIG. 6) impact. The diaphragm 22 is held this way only at its periphery. Operation of the device is described below. The main body part 11 is provided with an axial bore 25 to communicate compressed air which axial bore 25 is in parallel with cylinder bore 26 in which a piston such as in FIG. 6 reciprocates. The main body part 11 is also provided with radial bores 27 and 28 as in FIG. 1 which each may have companion radial bores 29, 30 as seen in FIG. 4 which communicate the cylinder bore 26 with the outside of the main body part 11. A flapper valve as described with reference to FIG. 5 is located in chamber 33 between shoulder 31 and rear face 32 of end plug 12.

In the signalling device as set out above, a disc 109 of a material such as an ACETAL polymer might be fitted into the recess 24 behind diaphragm 22. This disc acts as a buffer between piston and diaphragm, spreading the piston impact over a larger surface area of the diaphragm.

The flapper valve of FIG. 5 is shown in an exploded view. The valve comprises a front case 35 and a rear case 34 which come together with a disc 36 in place therebetween in chamber 37. Disc 36 is free to move axially in chamber 37 to open or close various ports so as to create two separate flows of compressed air, 38, 39 depending upon the position of the piston of FIG. 6 as will be described below.

The piston 40 of FIG. 6 is cylindrical in section and it is provided with a rearward section 41 having a diameter which is a close sliding fit in cylinder bore 26. The piston 40 has a forward section 42 with a reduced diameter by which a chamber is created between the piston 40 and the main body part 11. The forward end 43 of piston 40 is, in use, driven against diaphragm 22 to generate an acoustic signal.

The piston of FIG. 6 might be designed for multiple impacts per stroke. This could be achieved by inclusion of a piston(s) within the main piston The diaphragm could then complete one or more complete cycles of oscillation following the initial piston impact before the second and subsequent pistons impact.

In operation of the above device, compressed air can be fed from a scuba diver's tank via a suitable line connected at inlet 20 of end plug 12. Compressed air will be permitted to follow one or the other of the flow patterns 38, 39 depending on the position of disc 36 which in turn depends on the position of piston 40. Ultimately the compressed air is vented to the outside through radial bores 27, 28, 29, 30. Flow 38 is communicated to axial bore 25 and via a cutaway at 44 to the front end faces 45, 43 of piston 40. Flow 39 is communicated to axial bore 26 and end face 46 of piston 40. If the piston is at rest on the diaphragm then lower port 28 is closed. The length of piston 40 is such that upper exhaust port 27 is open. When compressed air is turned on there is a pressure difference across the valve disc 36; a low pressure via path 39 to the open exhaust port 27; and a high pressure via path 38 to the closed lower exhaust port 28. In this circumstance disc 36 is driven hard against front case 35 shutting off path 39. The air supply is now direct=d via path 38 to the front end of piston 40 via bore 25 and opening 44 to act first on face 45 and then additionally 43 as piston 40 moves away from the diaphragm 22. When piston 40 is at the top of bore 26, lower exhaust port 28 opens causing a pressure drop in path 38. The piston closes upper exhaust port 29 creating a high pressure in path 39. The valve disc 36 is now driven hard against rear case 34 and the air supply drives piston 40 via path 39. The piston 40 now travels down cylinder 26 to bang against diaphragm 22 and generate an acoustic impulse when the cycle is repeated to create a pulsed output lasting as long as the air supply is switched to the signalling device.

A study of the drawings will show that the main body part, end plug, locking ring, diaphragm and piston may be manufactured using common fabrication techniques requiring little more than bores and threads for straight screwed connections. With the illustrated structure, there is no requirement for sealing of the piston. The main body part may be machined from a noncorrosive material, as might the end plug and locking ring. The diaphragm is preferably a plate of spring grade stainless steel and a 48 mm diameter diaphragm might be 0.56 mm thick. The piston may be machined from a block of engineering grade plastic and a PTFE material is preferable. Alternately the piston might be a metal/plastic combination.

Figure 1:
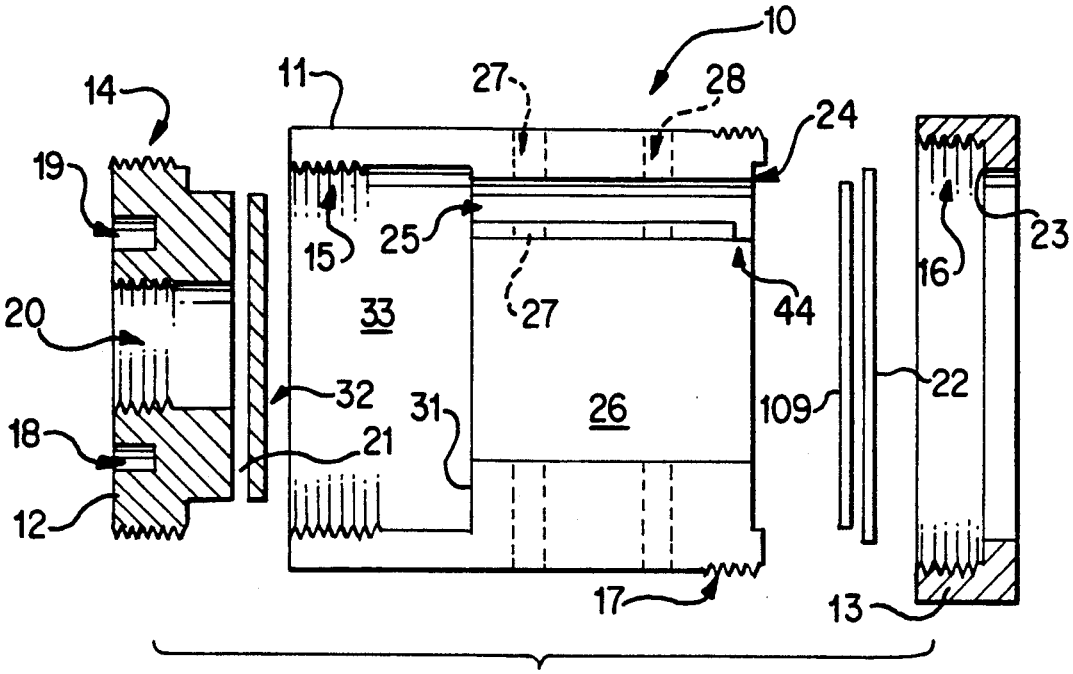
FIG. 1 is an exploded view of the main body part or cylinder, end cap, locking ring and diaphragm of a signalling device in accordance with the present invention.
Figure 2:
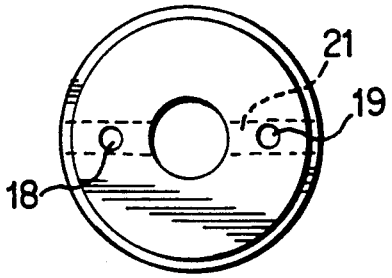
FIG. 2 is a view of the end plug at the inlet end of the signalling device as seen in FIG. 1.
Figure 3:
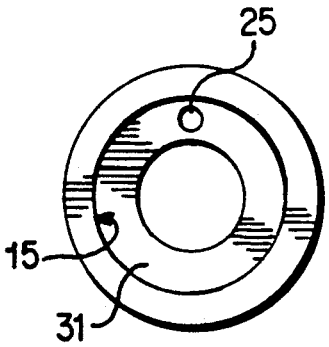
FIG. 3 is a view of the cylinder of FIG. 1 looking at the inlet end.
Figure 7:
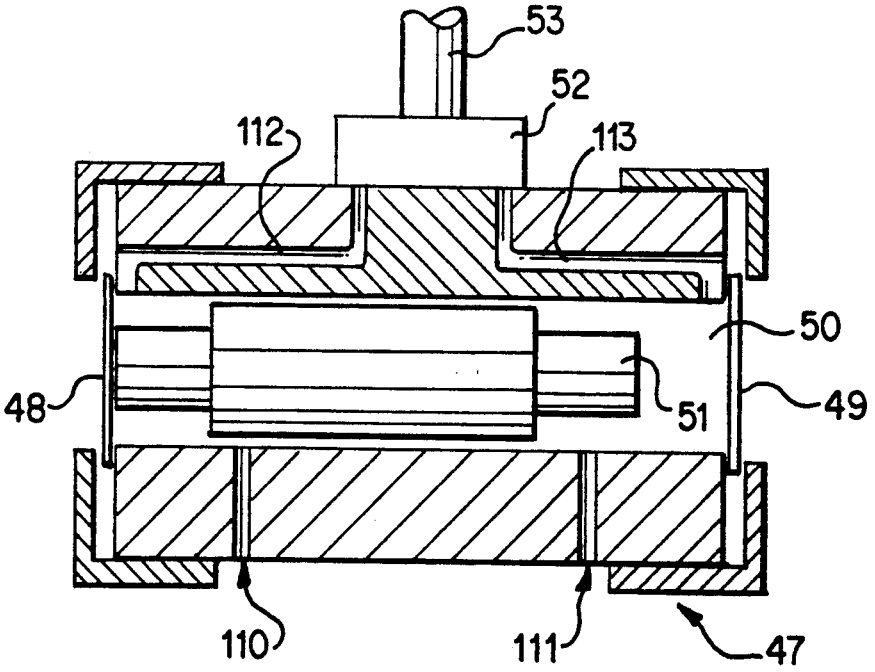
FIG. 7 is a schematic drawing setting out the internal geometry of an alternate signalling device in accordance with the invention.

FIG. 7 is a schematic layout of a double ended acoustic generator 47. A flapper valve is positioned at 52. It is positioned radially to control an air supply at line 53 feeding pressurised air alternately to inlet ports at the end of passages 112, 113. Opposed diaphragms 48, 49 are at each end of cylinder bore 50 wherein piston 51 is set to oscillate from one end to the other opening and closing exhaust ports 110, 111. Such an arrangement is topologically equivalent to the device of FIG. 1 so far as porting is concerned, a diaphragm replacing end plug 12. The axial valve of FIG. 1 is displaced sideways to a radial disposition. Such an arrangement can provide greater efficiency and a higher pitched and higher level acoustic output.

Figure 8:
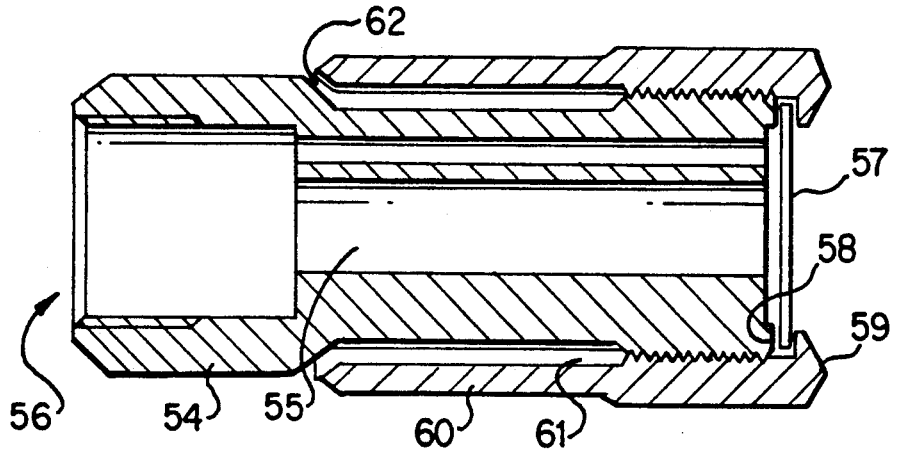
FIGS. 8 and 9 are axial sections through further embodiments of a signalling device in accordance with the invention.

The signalling device of FIG. 8 has a main body part 54 which is bored to provide a cylinder 55 in which a piston (not shown) reciprocates as described with respect to the previous embodiments. End 56 is open for insertion of a flapper valve and a locking closure with air inlet of the same type as set out above in the foregoing embodiments. The opposite end of the cylinder is closed by diaphragm 57 which is clamped to shoulder 58 by locking ring 59. In this embodiment the locking ring 59 is provided with a skirt or sleeve 60 which encircles the main body part 54 to create an annular space 61 which is vented at 62 to the outside. Air which causes the piston to reciprocate is exhausted into annular space 61. The rearward vent 62 causes exhaust air to leave the device rearwardly, away from the diaphragm so as to avoid any power loss which would occur if the diaphragm was to act on water containing air bubbles.

Figure 9:
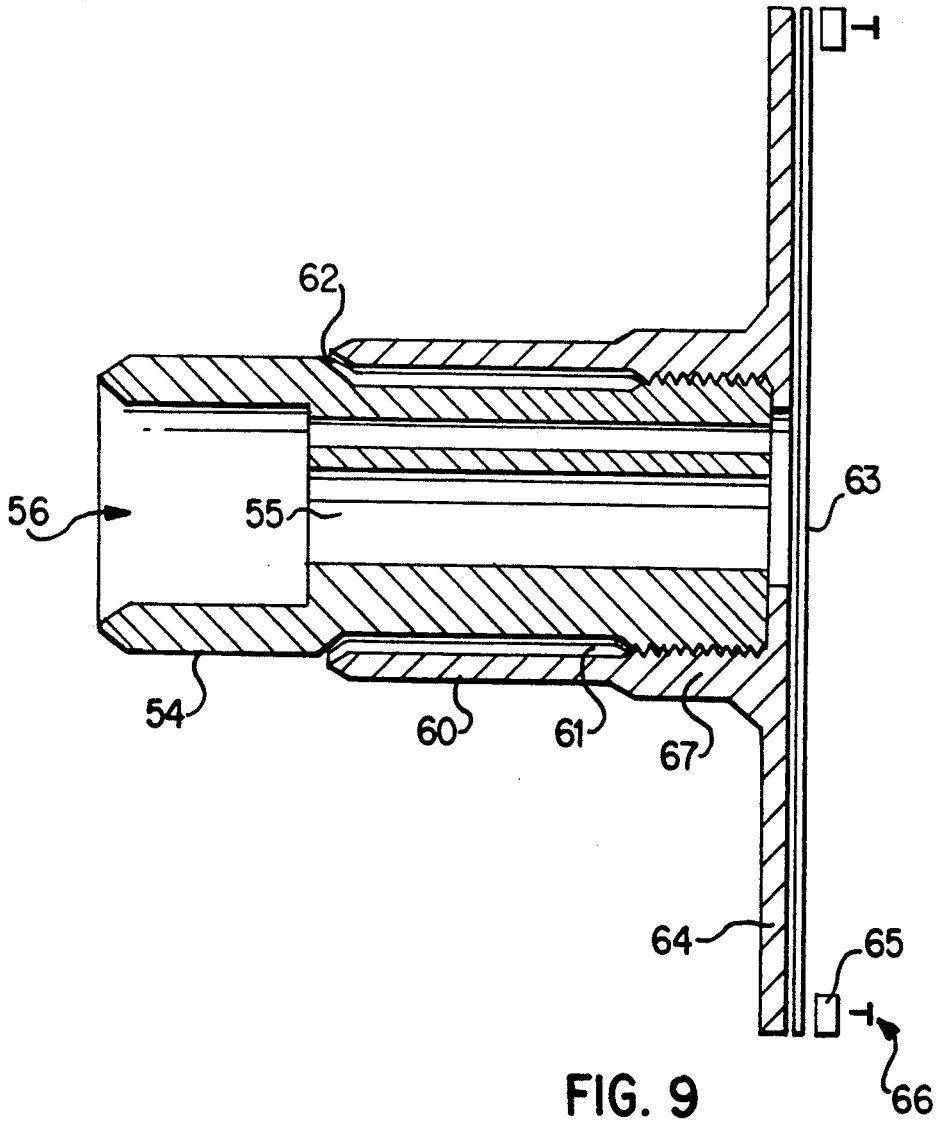

In the embodiment of FIG. 9, like parts as seen in FIG. 8 are numbered similarly. In FIG. 9, the diaphragm 63 is larger and attached at its periphery to a flange 64, being held thereto by clamping ring 65 which might be held by screws such as 66 to flange 64. Flange 64 is integral with sleeve 67 which supports skirt 60.

The larger diaphragm provides a means to generate more powerful acoustic signals.

The efficiency of the signalling device might be improved by placing a spring washer (spring steel, rubber, or other resilient material) between the diaphragm and locking ring.

Figure 10:
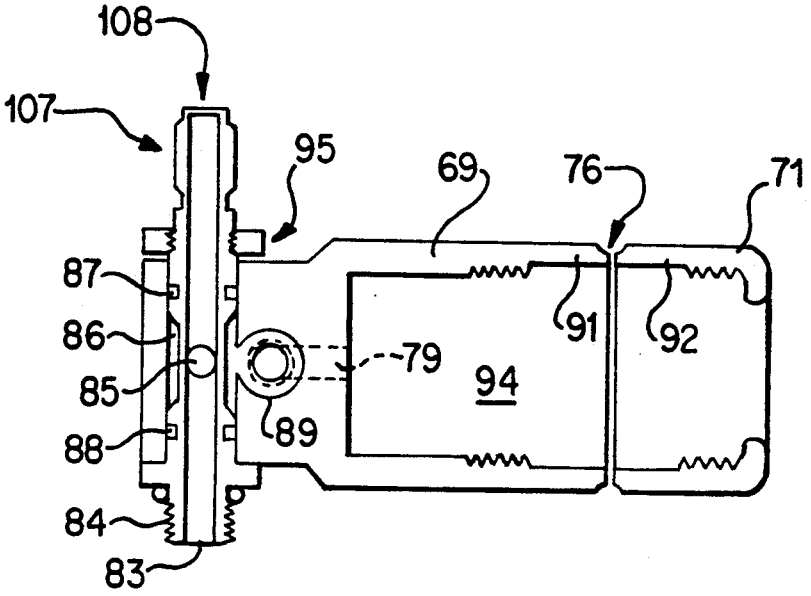
FIGS. 10 and 11 are axial sections taken at right angles to each other of a further signalling device in accordance with the invention.
Figure 11:
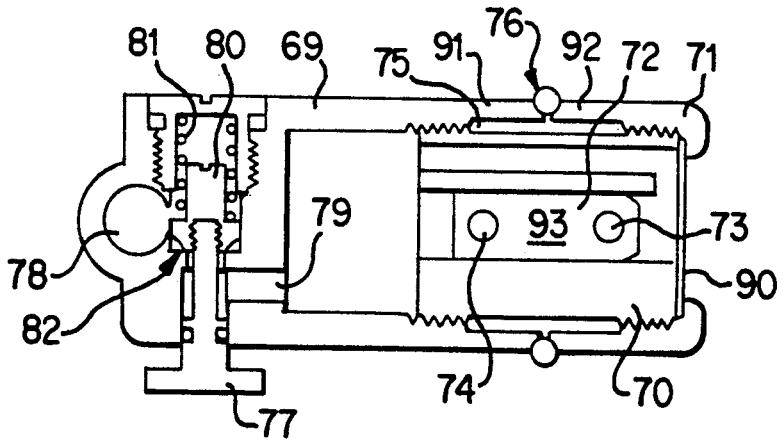

FIGS. 10 and 11 are sections taken at right angles to each other through the same signalling device. The main body part 69 and a cylinder part 70 (seen in FIG. 11 only) are screwed together to establish the configuration of previous embodiments. The cylinder part 70 is threaded externally at both ends. The cylinder part 70 is screwed into the main body part 69 with, in use, a flapper valve (not shown) between the cylinder part 70 and the base of the bore in the main body part 69. A locking ring 71 screws onto the end of the cylinder part 70 to clamp a diaphragm 90 to the end of the cylinder. Piston 72 is seen in FIG. 11, reciprocating in the cylinder to open and close ports 73, 74 to exhaust pressurised air from the device. The ports 73, 74 exhaust air into space 75 which is enclosed by two skirts 91, 92 which meet at a gap at 76 over which a seal 93 may be applied. The seal 93 may be a round-sectioned ring of suitably resilient material such as an O-ring.

The signalling device of FIGS. 10 and 11 is provided with a push button 77 by which pressurised air fed to inlet 78 may be ported to passage 79 to the space 94 in which the flapper valve (not shown) is mounted. The push button 77 acts on a valve body 80 which is biassed by a spring 81 to engage against a valve seat 82. A pressurised air line may be attached at 107 by way of a snap-on or quick-connect valved coupling, e.g. SCUBA buoyancy compensating device (BCD) inflator hose and coupling. Outlet 83 with thread 84 may be either sealed with a screw-on cap or screwed into a variety of SCUBA BCD's to allow the use of a common pressure line for both BCD and signalling device. The outlet could also be a quick connector snap on type of coupling. The inlet 108 leads to a passage 85 which opens into space 86 which is sealed at each end by seals 87, 88 about an insert providing the coupling which is locked into a bore in the main body part by a lock nut or spring clip (circlip) 95. Space 86 opens into passage 89 in the main body part in which the valve body 80 is contained. Space 86 opens upstream of valve seat 82 and its operation vents pressurised air into passage 79 to the flapper valve to effect operation of the piston. The stem of FIG. 10 with the snap-on connector at one end and the screw connector at the other provides dual connectors for an in-line connection of the signalling device between tank and BCD to do away with a need for extra lines.

Figure 12:
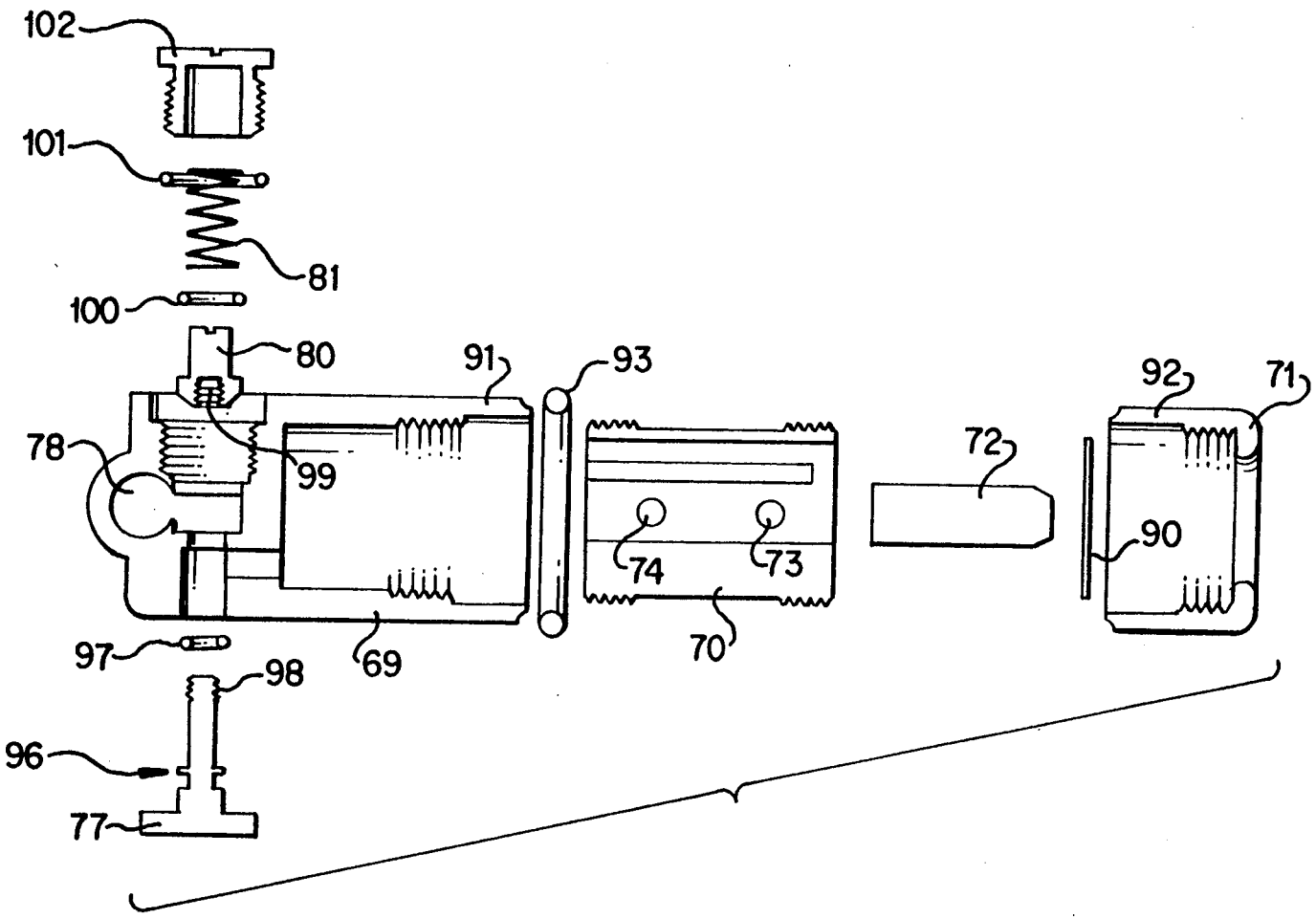
FIGS. 12 and 13 are exploded views of the signalling device of FIGS. 10 and 11.
Figure 13:
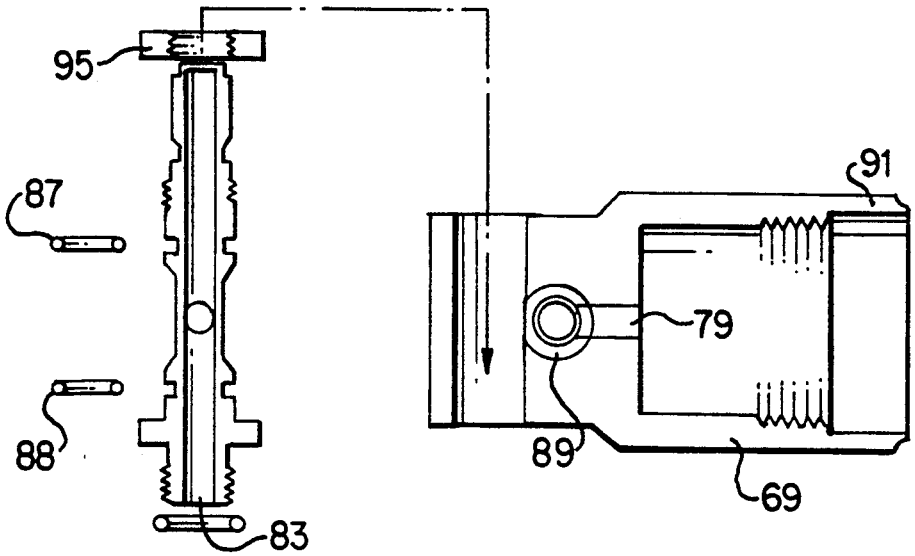

FIGS. 12 and 13 are exploded views of the parts of the device of FIGS. 10 and 11 shown in section view, the sections being orthogonal as with FIGS. 10 and 11. Like parts are numbered the same. The push button 77 has a seal 97 applied at 96 to seal its stem to the main body part 69. The stem is threaded at 98 to engage the valve body 80 at 99. The valve body 80 is provided with a seal 100 between it and the main body part and the spring 81 is captured in lock body 102 screwed into the main body part 69 and sealed thereto by seal 101.

Figures 14A, 14B:
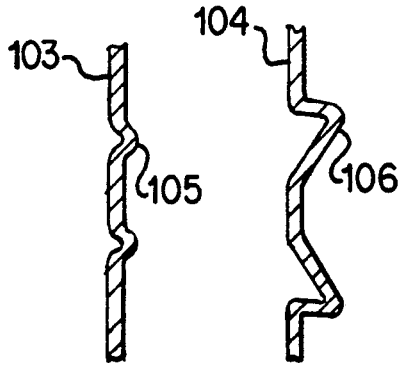
FIGS. 14A and 14B are sectional views through diaphragms showing how diaphragms might be adapted for greater output.

The amount of power generated by the diaphragm might be set by the size of the diaphragm. Alternately, the diaphragm might be provided with concentric grooves or a spring washer between diaphragm 90 and locking cap 92 (diaphragm 22 and lock cap 13 of FIG. 1). FIGS. 14A and 14B are a sectional views through diaphragms 103, 104 showing cross-sections of possible grooves 105, 106. In practice, the diaphragm is a disc and the grooves or ribs would be provided concentrically in the disc with one or more grooves or ribs at different radii from the disc centre.

Devices in accordance with the invention can be run on a range pressures, typically 30 PSI to 3,000 PSI. This enables them to be run directly from a typical scuba tank where the flow volume is limited by the tank valve (even with the valve fully open) The smaller units of FIGS. 10 to 13 are designed to run at pressures up to 160 psi, specifically connected to the low pressure outlet of a scuba first stage.

The above described invention provides a device that may be used to signal between divers or between a surface boat and divers, etc, to create a signal as might be used to warn of problems.

The invention described above comprises a structure that is readily realised utilising readily machinable parts with a minimum of working parts by which to generate underwater signals It will be clear to those skilled in the art that the specific constructional details may be varied within the scope of the invention as set out in the following claims.

In the above embodiments, either of an axial input or a radial input is disclosed as set out in the drawings. It should be clear that this is optional and the alternate form of input might be used. Thus the embodiments of FIGS. 10 to 12 is readily redesigned with an axial input.

I claim:

1. A signalling device for generating an audible sound in signalling to and between divers, said signalling device comprising:

a main body part having a bore along an axis therethrough which forms a cylinder having at least one open end;

a diaphragm fitted to the main body part over the at least one open end of the cylinder, the diaphragm being, in use underwater, in direct contact with water;

a piston having first and second ends and being movably contained within the cylinder for axial movement to and fro therein relative to the diaphragm, the second end impacting against the diaphragm during movement of the piston;

an air inlet component disposed in the main body part to which an air line is removably attached and through which pressurized air is supplied to the cylinder and the first and second ends of the piston; and a valve means, mounted in the main body part between the inlet component and the cylinder, for alternately allowing pressurized air to flow to the first and second ends of the piston;

wherein the valve means operatively interacts with the piston via passages in the main body which communicate the valve means with ports in the cylinder so that pressurized air is alternately allowed to flow to the first and second ends of the piston whereby the piston is repetitively driven against the diaphragm.

2. A signalling device as claimed in claim 1 wherein:

the diaphragm is a circular plate of resiliently deformable material clamped at its perimeter edge over the open end of the main body part by a locking ring.

3. A signalling device as claimed in claim 2 wherein:

the diaphragm is provided with concentric circular ribs to increase the degree of deflection of the diaphragm on it being struck by the piston.

4. A signalling device as claimed in claim 1 wherein: the ports of the cylinder are located at opposed ends on the exterior of the cylinder at positions spaced apart relative to the piston so that the piston acts as a valve sequentially opening the ports as it moves and thereby exhausts pressurized air at each end of its travel.

5. A signalling device as claimed in claim 4 wherein: the ports in the cylinder open beneath a shield which directs exhaust air away from the diaphragm.

6. A signalling device as claimed in claim 5 wherein: the main body part is cylindrical and the shield is a cylindrical sheath thereabout which is mounted to the main body part at the diaphragm end to enclose a cylindrical spaced defined between the main body part and the shield, the cylindrical space being open at an end opposite the diaphragm end.

7. A signalling device as claimed in claim 1 wherein: the main body part is provided with a flange about the open end, said flange extends orthogonally relative to the cylinder axis in the plane of the open end, the diaphragm being clamped at its periphery by a locking ring at the perimeter of the flange.

8. A signalling device as claimed in claim 1 wherein: the inlet component is provided with a push button operated valve whereby pressurised air can be selectively fed to the valve means.

9. A signalling device as claimed in claim 1 wherein: the main body part is a three part assembly comprising an internally threaded valve body part which is screw fitted onto a first end of an axially concentric peripherally threaded cylinder part therein with a further axially concentric, internally threaded diaphragm locking ring screwed onto a second end of the cylinder part, the valve body and locking ring being axially extended towards each other about the cylinder part to enclose an exhaust volume therebetween, the exhaust volume being ported to the cylinder near opposite ends of the piston's travel, a gap between the valve body and locking ring being fitted with a seal.

10. A signalling device as claimed in claim 1 wherein: the main body part is open at two opposed ends with axially concentric diaphragms at each end, and the piston is reciprocated between the two diaphragms under control of the valve means.

11. A signalling device as claimed in claim 1 wherein: a piston face of the second end which strikes the diaphragm has a radius which is less than a diameter of the piston where the piston contacts the bore to provide a pressure face between the bore and the piston.

12. A signalling device as claimed in claim 11 wherein:

the piston is bevelled at its diaphragm striking end.

13. A signalling device as claimed in claim 11 wherein:

the piston has a radially extended shoulder formed at a transition between the bevelled portion and another portion of the striking end.

14. A signalling device as claimed in claim 11 wherein:

a disc is interposed between the piston and the diaphragm.

15. A signalling device as claimed in claim 1 wherein: the main body part is provided with at least one axially extended bore which is parallel to the cylinder bore and which extends to the diaphragm to port pressurized air to the striking end of the piston.

16. A signalling device as claimed in claim 8 wherein: the inlet component incorporates a dual or multi purpose stem with at least one of a quick connect coupling point, a snap on coupling point, and a screwed coupling, to enable coupling of the input component to a variety of sources of compressed air.

17. A pneumatic signalling device for hand held use by divers, said signalling device comprising:

a main body part having a bore therein to form a cylinder having an open end;

a diaphragm fitted to the main body part over the open end of the cylinder, the diaphragm being, in use underwater, in contact with the water;

a movable piston having first and second pressure faces at opposite ends thereto and being contained within the cylinder for movement to and from therein, such that the end associated with the first pressure face impacts against the diaphragm;

an inlet component which is connected to the main body part and to which an air line is movably attached so that feed air under pressure is supplied to the inlet component; and a bi-stable flapper valve mounted in the main body part between the inlet component and the cylinder, said flapper valve receiving pressurized air via the inlet component and communicating with the cylinder via ports in the cylinder;

wherein the flapper valve operatively interacts with the piston such that when pressurized air is supplied to the flapper valve, the pressurized air alternatively and repetitively applied to the first and second pressure faces so that the piston is moved to and fro within the cylinder and the first pressure face repeatedly impacts the diaphragm generating an acoustic signal as the diaphragm contacts the water, and wherein the bi-stable valve is subjected to a pressure differential thereacross due to the piston movement causing the bi-stable valve to switch positions.

18. A pneumatic signalling device for hand held use by divers, said signalling device comprising:

a main body part having a bore therein to form a cylinder having an open end;

an input component capable of receiving pressurized air and being connected to said main body;

a diaphragm fitted to the main body part over the open end of the cylinder, the diaphragm being, in use underwater, in contact with the water;

a piston disposed within the cylinder which is movable to and fro within the cylinder for repetitively impacting on the diaphragm;

a valve disposed between the input component and the piston, the valve allowing pressurized air to flow to opposite ends of the piston to effect a repetitive movement of the piston and its repetitive impact on the diaphragm;

a sleeve disposed around the main body part;

exhaust ports in the cylinder for exhausting pressurized air to an annular space formed between the main body part and the sleeve;

wherein the annular space is opened to exhaust pressurized air at a point removed from the diaphragm.

19. A signalling device as claimed in claim 14, wherein the disc is acetal polymer.

* * * * *